United States Patent [19]

Cooper et al.

[11] 4,024,694

[45] May 24, 1977

[54] APPARATUS FOR FILLING AND ASSEMBLING CUPS AND PROCESS THEREFORE

[76] Inventors: Marvin Cooper, 59 Fisherville Ave., Willowdale; Gino Franco, 235 Margaret Drive, Oakville, both of Canada

[22] Filed: June 18, 1976

[21] Appl. No.: 697,675

[52] U.S. Cl. ..... 53/282; 53/173

[51] Int. Cl.[2] ..... B65B 1/12

[58] Field of Search ..... 53/170, 173, 282

[56] References Cited

UNITED STATES PATENTS 3,293,823 12/1966 Anderson ..... 53/282 X 3,851,445 12/1974 Schuh ..... 53/282 X

*Primary Examiner*—Travis S. McGehee

[57] ABSTRACT

Apparatus for filling and assembling single serving beverage cups in which single serving beverage concentrate containers as sequentially filled from at least two and in some cases three separate beverage concentrate supply means with predetermined exactly metered quantities of beverage concentrate, and are then sealed and in which the containers are then transferred from one conveyor to another and are inserted into single serving beverage cups, on the second conveyor, and pressed firmly into the bottom thereof to engage suitable retaining means located in the side walls of the cups.

9 Claims, 11 Drawing Figures

APPARATUS FOR FILLING AND ASSEMBLING CUPS AND PROCESS THEREFORE

The invention relates to apparatus for filling and assembling cups, containing a sealed single serving of a beverage.

BACKGROUND OF THE INVENTION

Many proposals have been made for the construction of a cup containing a single serving of a beverage concentrate material. A sealed container within the cup will contain the beverage concentrate, and, when the sealed container is opened, and water, either hot or cold, or other mix, is added to the cup a single serving of beverage, in the cup is provided ready for consumption. Such cups have many advantages over other forms of dispensing servings of beverage. They may be used in a wide variety of locations such as offices, barber shops, and at sporting events where permanent snack bar facilities are not available, or in emergency situations, or in any other situation where it is desired to provide a large number of servings of beverages without any facilities beyond the provision of water or mix.

Such cups may be manufactured in large quantities, each containing a single portion of beverage concentrate hermetically sealed and therefore capable of being stored for an extended shelf life. Such cups may be nested and packaged in bulk and shipped to the location as required.

Examples of such cups are shown in U.S. Pat. Nos. 3,561,664, 3,407,922, 2,972,406, 1,889,111, 3,186,850.

A particularly advantageous form of such single serving cup is disclosed in U.S. Pat. No. 3,870,220 assigned to Insta Cup Incorporated. In this form of cup, the container for the beverage concentrate is made of a material which will withstand the application of hot or boiling water without contaminating the beverage. In this way, it is possible for the container to be placed in the bottom of the cup, and to remain there while the beverage is consumed. The top of the container is open, and is sealed with any suitable removable seal such as a metallic foil material. All that is then necessary is to simply tear away the top seal, and add water or other mix.

The container for the beverage concentrate is retained within the cup by engagement with a lip formed in the side wall at the lower end of the cup. It can therefore be inserted, after the container has been filled, and simply retained by pressing it past the lip thereby making a snap fit in the bottom of the cup.

This form of cup lends itself particularly well to automated manufacturing and filling techniques. Various problems are present however in such automated filling proceedures. For example, in order to provide a variety of different beverages, it is necessary that containers be filled with different beverage concentrates. In order to provide a product having a wide sales appeal it is likewise necessary that the beverage concentrates be of the highest quality and maintain strict standards. Single servings of such beverage are however provided by very small quantities of for example powdered beverage mix materials. Such materials vary in consistancy some being a very fine powder and others being more granular, and the handling of such very small quantities of beverage concentrate mixes, at high speeds, and achieving accurate measured volumes to maintain standards of quality presents a number of serious difficulties.

Clearly, in order for the whole proceedure to be economically sound, the concentrate containers must be filled and then inserted in the cups at a high rate of production, without human intervention.

BRIEF SUMMARY OF THE INVENTION

It is therefore a principal objective of the invention to provide apparatus for filling and assembling single serving beverage cups in which single serving beverage concentrate containers are sequentially filled from at least two and in some cases three separate beverage concentrate supply means with predetermined exactly metered quantities of beverage concentrate, and are then sealed and in which the containers are then transferred from one conveyor to another and are inserted into single serving beverage cups, on the second conveyor, and pressed firmly into the bottom thereof to engage suitable retaining means located in the side walls of the cups.

Preferably, in accordance with the invention these steps will be carried out on a continuous basis in sequential steps, and then inserted sequentially into cups, the entire operation being carried out continuously.

Preferably, in accordance with the invention the cups once they have received the containers, are then automatically assembled in nested formation, and pressed home into cartons already prepared and set up to receive such nested cups. In this way, all that is necessary to be done to maintain the process in continuous operation is simply to supply sufficient quantities of concentrate containers, lids and cups, and sufficient quantities of beverage concentrate, all of the other steps being entirely automatic.

Preferably, in accordance with the invention the beverage concentrates are supplied by means of three separate hopper feed systems, two of such hopper feed systems being suitable for handling irregular or granular materials, and a third hopper system being suitable for handling fine powder materials. Preferably, this feature of the invention provides hopper feed systems in which the two hoppers for irregular or granular materials are provided with slide feed systems, and in which the third hopper for fine powder materials is provided with an auger feed system. In this way, irregular or granular materials such as for example noodles, when used in soup, or sugar or powdered milk, when used in a hot beverage mix, may be fed through the two slide feed hoppers. The finely powdered soup concentrate, or for example coffee concentrate may be delivered through the auger feed hopper. The accuracy of the auger feed system is generally considerably greater than that of the slide feed system, and can also be regulated or adjusted so as to increase or decrease the dosage of the concentrate powder. This makes it possible to supply for example cups in which the coffee dosage is either strong or week thereby accommodating a greater range of individual selections, while maintaining high standards of accuracy.

The apparatus according to the invention will also include a lid dispensing and heat sealing station, for dispensing and heat sealing lids on the concentrate containers, and may also incorporate a date stamping or coding station. Preferably, two separate conveyor systems are provided arranged end to end, with the concentrate containers being filled and sealed on the first conveyor. The second conveyor receives the actual cups themselves, and some form of transfer mechanism is provided for transferring the filled and sealed concentrate containers from the first conveyor and placing them in the cups in the second conveyor. At a further station on the second conveyor, some form of pressure means is provided for pressing the containers home into the bottom of the drinking cups. A stacking station may also be provided for stacking the cups in a nested arrangement.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF A SPECIFIC EMBODIMENT

Figure 4:
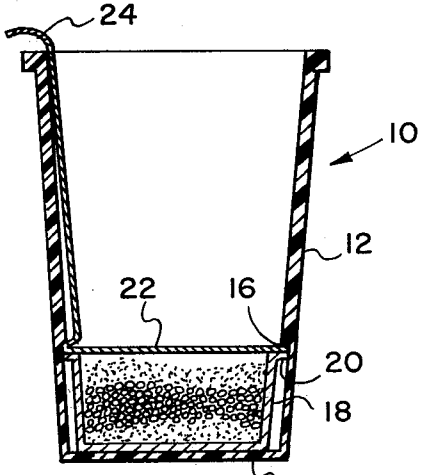
FIG. 4 is a section of a cup and container.
Figure 5:
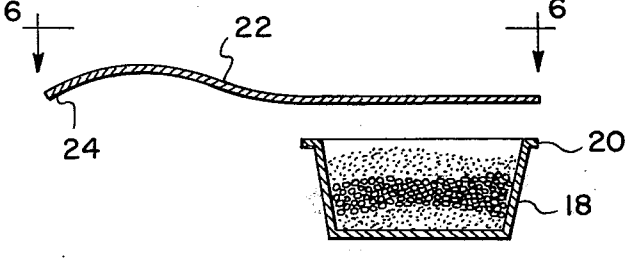
FIG. 5 is a section of a container with lid removed.

Referring first of all to FIGS. 4 and 5, these figures show the cup and container which are the subject of the apparatus according to the invention. It will of course be appreciated that the invention is not exclusively confined to a cup and container of this specific design and dimensions, but is of wider application. The description of the cup and container and the illustrations in FIGS. 4 and 5 are therefore merely illustrative of a preferred embodiment of the invention.

As shown, the cup shown as 10 has a generally conical side wall 12 and a flat bottom 14. Within the interior of the side wall 12, towards the bottom 14, there is provided a rib 16. A container 18 is located in the interior of the bottom of the cup 10 having a lip 20 which is engaged beneath the rib 16.

The container contains any suitable beverage concentrate material (not shown). The container 18 is sealed by means of a top closure panel 22 fastened to the top flange 20 of the container 18. A tab 24 connected to the closure 22 extends out of the top of the cup 10 and permits the user to tear off the closure 22 without reaching into the cup 10.

The container 18 remains retained in the bottom of the cup 10 engagement of the flange 20 with the rib 16.

Boiling water is simply added to the interior of the cup 10 by and dissolves the beverage concentrate in the container 18 and the contents can then be consumed.

As noted above, all of these features are disclosed in U.S. Pat. No. 3,870,220, and are merely described herein by way of convenience and for the sake of simplicity of explanation.

In accordance with the invention, the apparatus makes provision for the filling of the containers 18 with suitable quantities of beverage concentrate, and the containers 18 are then closed and sealed with the closure panel 22, and are then inserted into the cups 10 and are pressed home so that the flange 20 snaps beneath the rib 16 in the side wall 12 of the cup 10.

Figure 3:
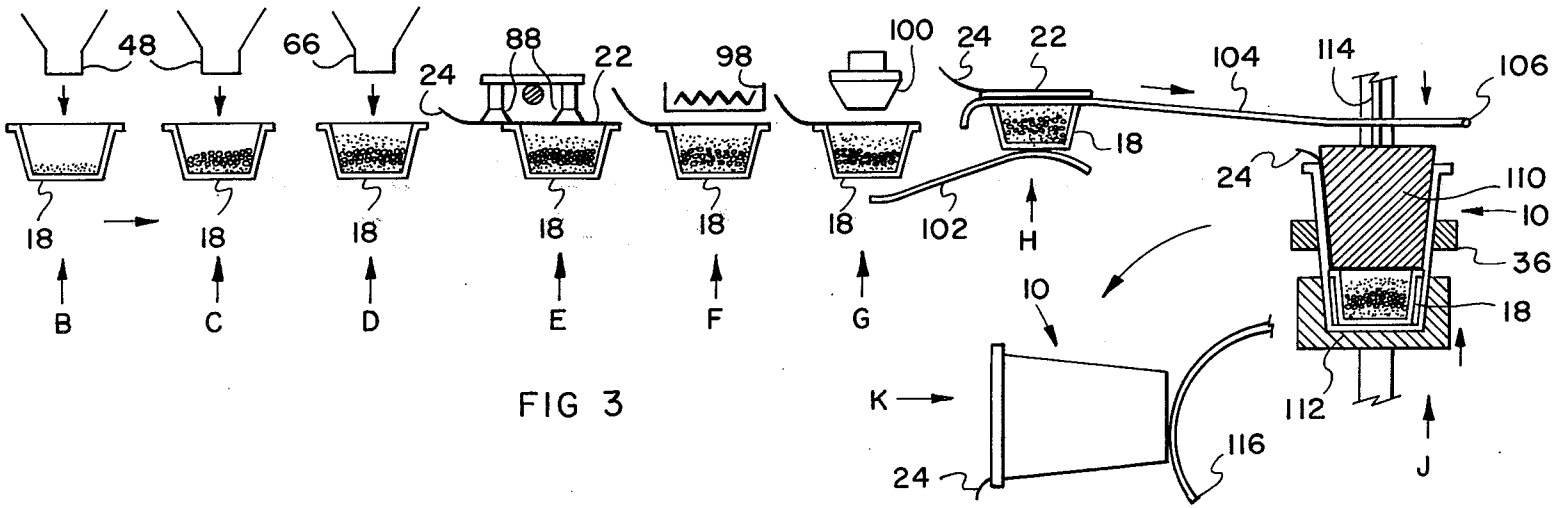
FIG. 3 is a schematic illustration showing the sequence of steps according to the invention.

These various steps are disclosed schematically in sequence in FIG. 3.

Figure 2:
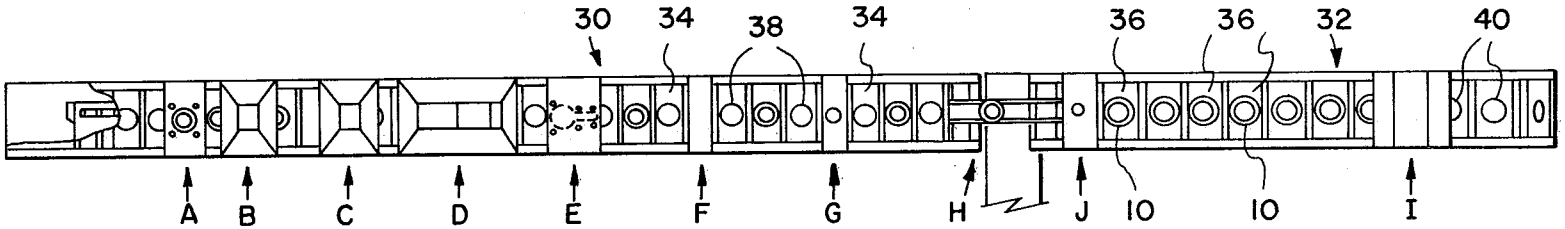
FIG. 2 is a top plan view corresponding to FIG. 1.
Figure 1:
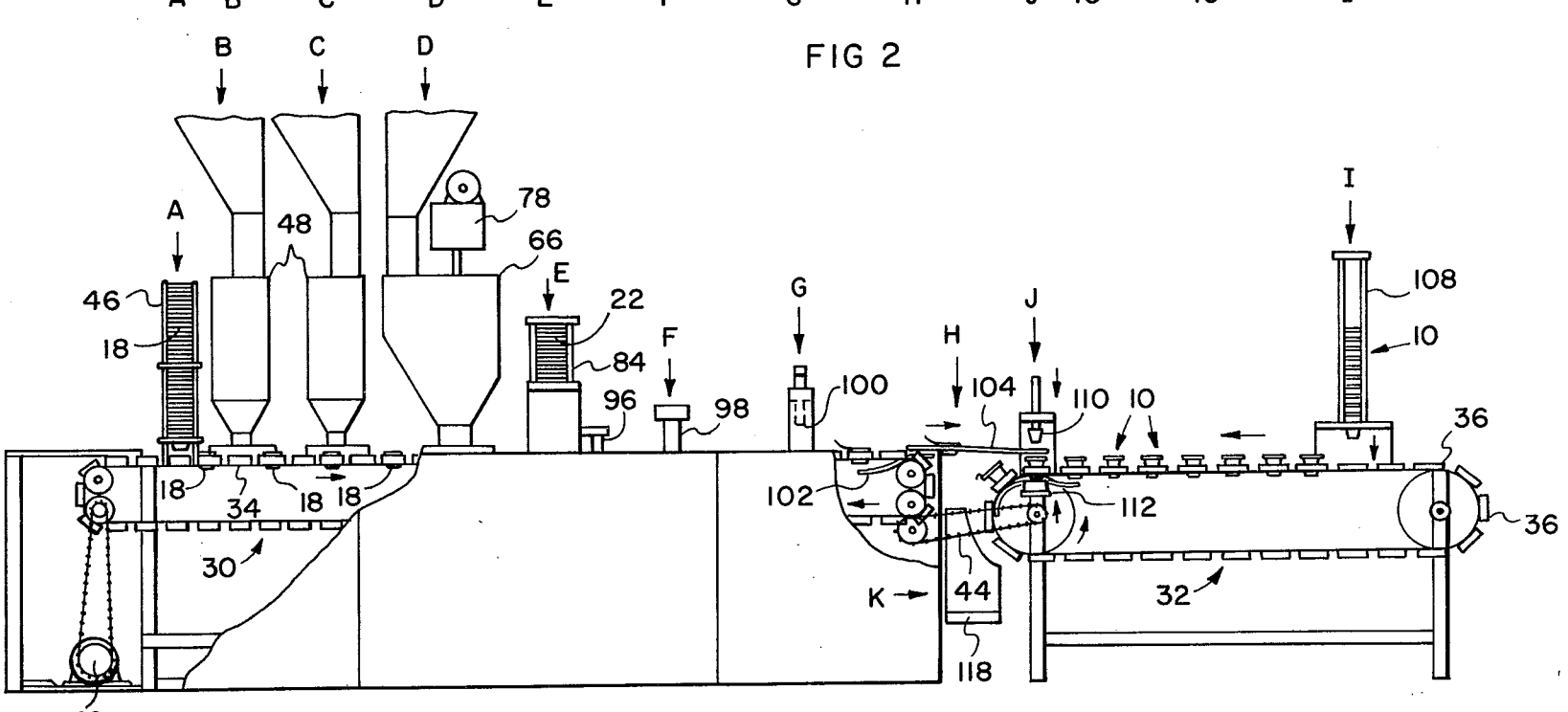
FIG. 1 is a schematic side elevational view of the apparatus according to the invention, partially cut away.

The apparatus for carrying out these steps is shown in general in FIGS. 1 and 2. It will be seen to comprise essentially two separate conveyor systems 30 and 32, the conveyor 30 being provided for conveying the containers 18 and the conveyor 32 conveying the cups 10. Typically, the conveyors 30 and 32 will comprise continuous chains, running around suitable sprockets, and provided with transverse support bars 34 and 36 respectively. The support bars 34 and 36 may be of any suitable width and are provided with recessed or openings 38 and 40. Only a single opening is shown on each bar, for the sake of simplicity. It will of course be appreciated however that the number of such recesses is not critical to the invention. It could be increased, by simply extending the length of the bars and forming more recesses in the bars, depending upon the production volume required.

Conveyor 30 is driven by means of a drive motor 42, and conveyor 32 is driven by the connecting drive 44 connecting between conveyor 30 and 32. The motor 42 may be timed by any suitable programmer (not shown) or may drive any suitable form of clutch mechanism, or other intermittent drive (not shown) so as to provide an intermittent step-wise drive, so that each of the bars 34 and 36 is stationary when it registers with each particular operating station, to be described below.

These stations will now be described in detail.

STATION A

Station A comprises a vertical support column shown generally as 46 providing support for a stack of containers 18. At the lower end of the column 46, there is provided any suitable form of release machanism (not shown). Such release mechanism will be operated in timed relation to the sequential movement of the conveyor 30 so as to release one container 18 from the column 46 which will then drop into its respective opening 38 in the bar 34. Such release mechanisms are well known in the art, and are not described herein in detail for the sake of clarity.

STATION B and C

Stations B and C are identical, and only station B will therefore be described in detail, it being understood that the details of station C are identical.

As shown in FIG. 1, station B is seen to comprise a generally hopper-like container 48, for containing quantities of any one of a variety of different powdered materials which may be deposited in the containers 18. Such powdered materials will normally be of the more granular or coarser grain material which runs or feeds relatively easily under the influence of gravity, or with only minor agitation. Within the hopper or container 48, there may be provided any simple form of agitation means (not shown) such as is well known in the art and requires no further explanation.

Figure 7:
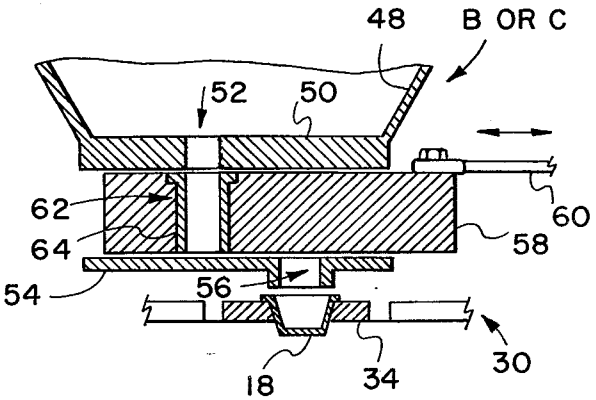
FIG. 7 is an enlarged sectional view of one of the hopper feed systems shown along the line 7—7 of FIG. 2.

The feed mechanism for station B is shown in FIG. 7. It will be seen to comprise a horizontal bottom plate 50 at the bottom end of hopper 48 having a feed opening 52 therein. A lower feed plate 54 is provided having a feed opening 56 formed therein offset relative to opening 52 in plate 50. Plates 50 and 54 are secured to each other by any suitable means such as bolts (not shown). Hole 52 is closed by means of the slide plate member 58 which is slidable to and fro horizontally, between plate 50 and 54 by means of the arm 60.

Arm 60 is operated by any suitable drive mechanism, (not shown) which is operated in timed relationship with the movement of the conveyor 30.

Slide plate 58 has a vertical bore 62 and sleeve 64 for transmitting a measured quantity of powdered material there through.

Such dosage may be regulated in various ways. For example the sleeve 64 may be interchangeable with a larger or smaller diameter sleeve. Other systems are known in the art and will not be described herein for the sake of clarity.

In this way, the dosage or charge delivered by the feed mechanism of station B can be varied. Such a dosage regulation systems works quite effectively with relatively coarse granular materials which flow easily under the influence of gravity. As mentioned, in order to ensure such a gravity flow, the side walls of the hopper 48 are formed at a fairly steep inclined angle as shown, any any suitable agitation means may be provided if desired within the hopper 48, the details of which will be apparent to persons skilled in the art.

As mentioned above, the details of station C are identical. In this way, charges of for example sugar from one hopper, and powdered milk or cream from the other hopper may be deposited in the containers 18 as they move from hopper to hopper along conveyor 30. Other materials which may be fed in this manner are for example noodles or other materials of a similar easy flowing nature.

STATION D

Station D provides for the depositing of charges of material which is generally speaking of a finer grain nature. Alternatively, where the dosage measurement required for the material must be more accurately controlled than in the case of stations B and C, then such materials can be delivered from station D which provides for a more accurate degree of dosage control, in addition to being able to handle much finer grain powders which have tendency to bind or stick in the hopper.

Various forms of auger feed devices are available on the market which will serve this purpose. For example the augar system manufactured by Compacting Press Corp., of Bethlehem, Penn., is one such system.

Figure 8:
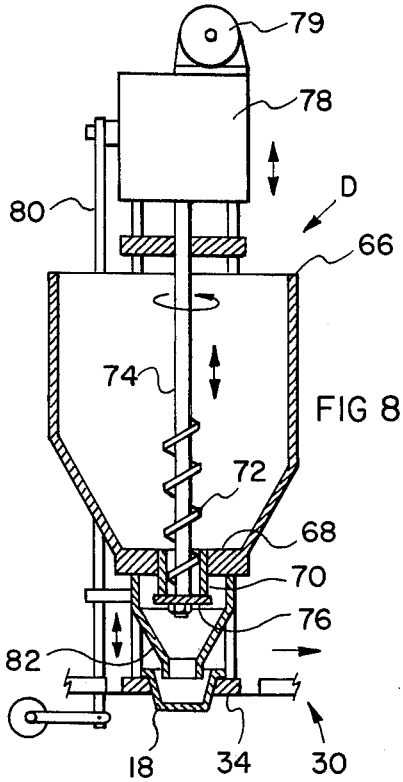
FIGS. 8 and 9 are sections of another hopper feed system, along the line 8—8 of FIG. 2 shown in two positions.

One such auger device is shown by way of example in FIGS. 1, and 8. It will be seen to comprise a generally hopper-like tank or container 66 having at its lower end steeply inclined side walls as shown to promote free flow material. At the bottom end of the container 66 there is a bottom plate 68 having a sleeve 70 passing therethrough.

Within the sleeve 70 there is a rotary auger feed device 72 on a shaft 74. At the bottom end of the shaft a closure 76 closes off the lower end of sleeve 70. Closure 76 also acts as a spinner for dispensing the powdered material.

The auger is rotatable and slidable within the sleeve 70. Any suitable form of agitation means is located within the hopper 66 the details of which will be apparent to persons skilled in the art and require no further explanation.

In order to rotate shaft 74 any suitable drive mechanism such as a gear train or chain drive or the like is provided, in housing 78 having a motor 79 driving through any suitable clutch or like intermittent drive, the details of which will be self evident to persons skilled in the art and require no further explanation.

The housing 78 is mounted for vertical sliding movement which is procured by any suitable movement mechanism such as the connecting rod 80. This is only one means of procuring downward and upward movement and any other movement means will be suitable as will be apparent to persons skilled in the art.

This will cause downward and upward movement of the auger in the sleeve.

Regulation of the dosage or charge delivered by the auger 72 is effected adjusting the speed of motor 79, or by any other means.

A movable funnel 82 is located below sleeve 70, and is moved by connecting rod 80, downwardly and upwardly.

The dosage thus delivered can be regulated with great accuracy. In fact, it makes it possible to provide for regulation of dosage of for example powdered coffee concentrate so as to provide either strong or regular or weak cups of coffee as desired. This accurate dosage adjustment will be maintained to a very close tolerance over extended periods of use since rotary auger systems such as that described herein provide for a high degree of accuracy during use.

Clearly however, other auger systems will provide sufficient accuracy, and the present system is described merely by way of example.

In addition, the accurate dosage regulation of such relatively expensive raw materials as powdered coffee concentrate or powdered soup and the like ensures that there is no wastage of expensive raw materials during processing.

STATION E

Figure 9:
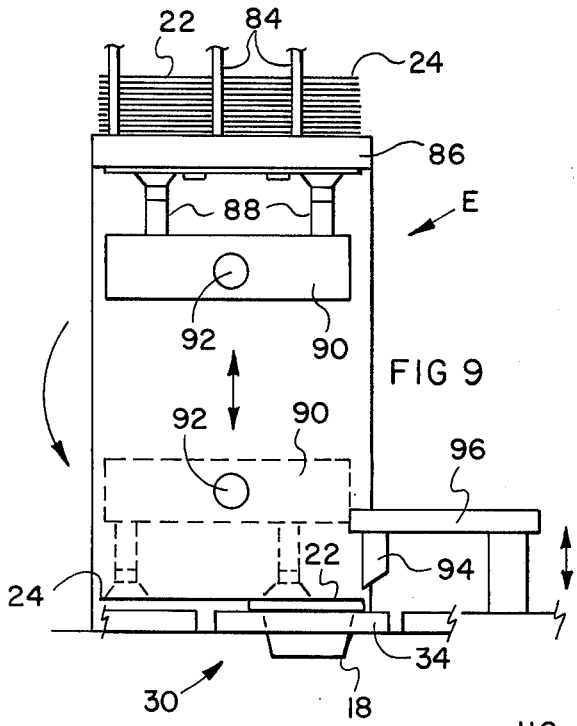

Station E is shown in FIGS. 1, and 9.

Figure 6:
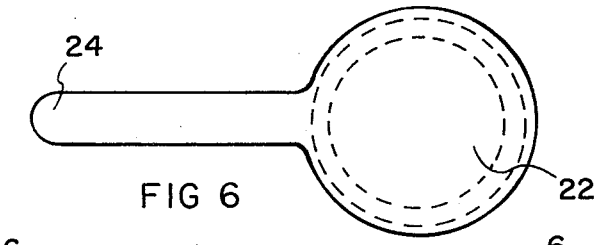
FIG. 6 is a top plan view of the container lid.

As shown generally in FIG. 1, it consists of a series of vertical support rods 84 for supporting the closure members 22, with their integral tags 24, in a vertical stack registering with containers 18 on the conveyor 30. The support rods 84 are mounted at their lower ends on plate member 86. The plate member 86 has an opening (not shown) essentially the same size and shape as the closures 22 and their tags 24 (see FIG. 6) with any suitable retaining means (not shown) for retaining the stack of lids or closures 22 therein.

Lids or closures 22 and their tags 24 are removed one at a time from each of the stacks by suitable means such as pneumatic fingers 88. Such fingers are for example to those used in printing presses and the like for feeding single sheets or paper. They have suction heads and apply suction to the lowermost lid 22 and its tag 24 in the stack, when in the upper position as shown in FIG. 9.

The fingers 88 may be mounted on a movable block member 90 which is mounted for rotational movement, and vertical reciprocation or trunion bearings 92. In order to rotate the block member through 180°, while it is travelling from its upper to its lower position as shown in FIG. 9, any suitable mechanism may be provided. For example such mechanism may be similar to that used on inking stamps, or the like.

In the upper position the fingers engage the lowermost of the closure lids 22, and in the lower position they will deposit a single lid 22, together with its tag 24, in position as shown by momentarily releasing the suction thereon.

In order to hold the lid 22 in position, there is provided a heating element 94 movably mounted on any suitable support arm 96 which may be moved upwardly ad downwardly by any suitable means (now shown) as shown in FIG. 9. The heating element 94 applies heat and pressure at a point on the edge of the lid 22 as shown thereby tacking it to the container 18 so that it cannot move.

STATION F

Station F is only shown in general in FIG. 1. It consists simply of a larger heat sealing element 98, which is movable between upper and lower positions. Such heat sealing elements are essentially well known in the art and require no detailed description. It will merely apply heat and pressure around the perimeter of the lid 22 on the container 18 thereby heat sealing it in position, and hermetically sealing the container.

STATION G

Similarly, station G is shown only generally in FIG. 1. It consists essentially of a date stamping or coding device 100, the details of which are essentially well known in the art. It will move between upper and lower positions and simply apply a mark or date stamp to the closure 22.

STATION H

Figure 10:
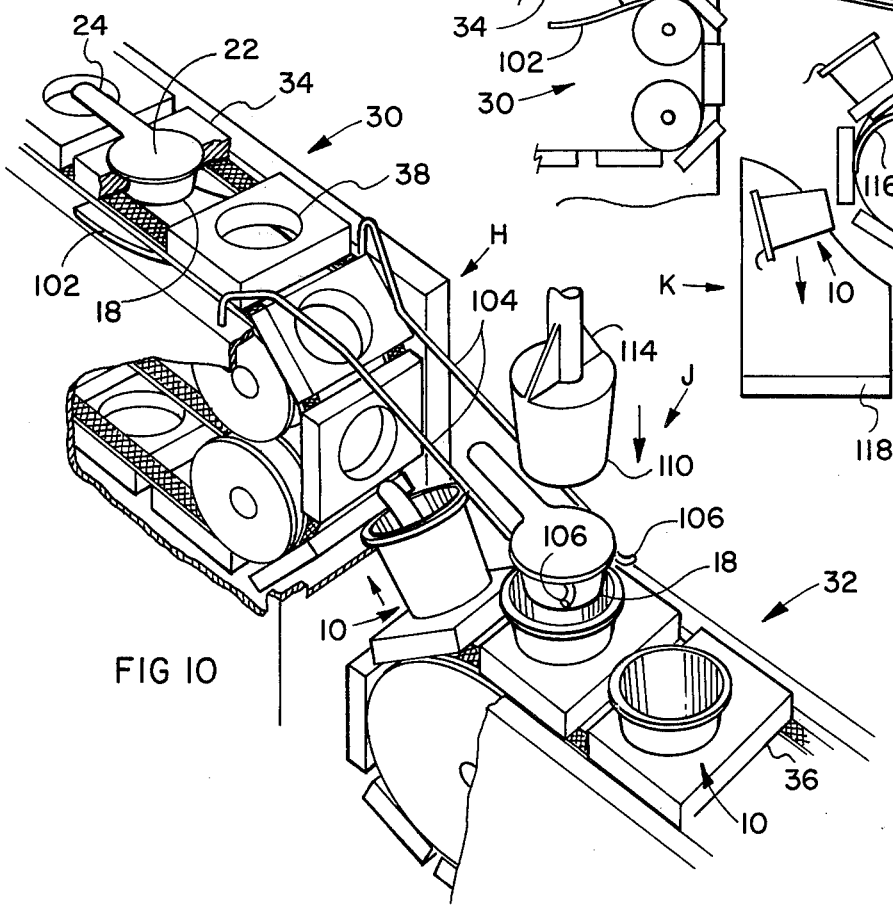
FIGS. 10 and 11 are sections of the mechanism for dispensing lids, along the line 10—10 of FIG. 2 shown in two positions.
Figure 11:
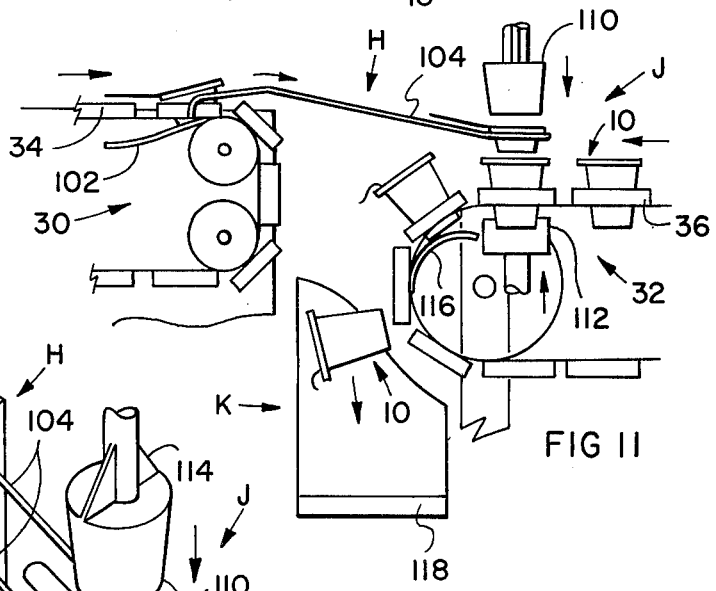

Station H is shown in FIGS. 1 and 3 and also in FIGS. 10 and 11. Its function is to pick up the sealed container 18, from the conveyor 30 and transfer it to a cup 10 on conveyor 32. These movements are illustrated essentially schematically in FIG. 3 at station H.

The mechanism by which such a transfer is performed is shown in FIGS. 10 and 11. It will be seen to comprise a lifting ramp 102 located below the conveyor 30, and arranged to engage the underside of the container 18 and to push it upwardly out of the opening 38 in which it is resting.

A pair of transfer rails 104 are located at the end of the conveyor 30, and are shaped so as to slide beneath the flange 20 of the container 18 so that the container 18 can slide forwardly on to the rails 104. The rails 104 are angled slightly downwardly so as to carry the container 18 under the influence of gravity to the far end thereof. The free ends of the rails 104 are inturned as at 106 to provide resilient stop members. The rails 104 are preferably somewhat flexible and resilient so that they may spring apart.

The location of the stop member 106 is such as to register a container 18 resting thereon centrally with respect to a cup 10 on conveyor 32.

It will of course be appreciate that other transfer means could be provided. For example, the rails 104 could be power operated so that they move apart at a predetermined point in the cycle so as to drop the container 18 into the cup 10, or other forms of transfer could be provided.

It will also be appreciated that the movement of the container 18 along the rails 104 may also be controlled by some form of power operated means. Alternatively, some form of pusher element (not shown) may be provided on alternate bars 34 of the conveyor 30 so as to continue pushing the container 18 as the conveyor 30 moves in the manner described above.

STATION I

Station I is shown only in general outline, in FIG. 1. It consists essentially of a vertical magazine or support 108 receiving a stack of nested cups 10. The magazine 108 is provided with any suitable form of feed mechanism, for feeding cups 10 one at a time into respective openings 40 in bars 36 of conveyor 32. It will of course be appreciated that conveyor 32 is moving in the opposite direction to conveyor 30.

The details of such a feed mechanism are omitted for the sake of clarity, being essentially of any well known type of construction such as is available in the art.

STATION J

The function of station J is to press the container 18 firmly home into the bottom of the cup 10, thereby engaging the flange 20 beneath the rib 16 in the side wall 12 of the cup 10 (see FIG. 4).

It comprises essentially a plunger or pressure member 110 which is operated upwardly and downwardly by any suitable power means such as a pneumatic cylinder, or mechanical linkage or the like (not shown) which will be operated in time relation to the step wise operation of the conveyors 30 and 32.

The plunger 110 is located so as to register with a container 18 resting on the rails 104 against the stop member 106. The step wise movement of the conveyor 32 is such as to locate a cup 10 precisely beneath the container 18. Downward movement of the plunger 110 will force the container 10 through the rails 104, which will spring apart to permit such downward movement, and the plunger 110 will then press the container 18 firmly into the base of the cup 10.

In order to support the bottom and walls of the cup 10 while such downward pressure is applied by the plunger 110, a lower platen member 112 is mounted directly beneath the plunger 110, on the under side of the conveyor 32, on any suitable vertical reciprocating mechanism (now shown) such as pneumatic cylinder or the like. The platen member 112 is shaped to receive the base and a portion of the side walls of the cup 10 and support it while the plunger 110 applies pressure to the container 18 (see FIG. 3).

In order to hold the rails 104 apart, when the plunger 110 returns on its upward stroke, guide plates 114 may be located on either side thereof as shown in FIG. 10.

STATION K

At station K, th cups 10 containing the containers 18 are ejected from the conveyor 32, and passed to a packaging station.

Station K comprises a ramp 116 located beneath the rails 36 of conveyor 32 and adapted to engage the underside of each cup 10 and to lift upwardly. In addition, a transverse conveyor 118 may be provided for catching the cups 10 and delivering them to one side so that they can then be nested and packaged.

It will thus be seen that the process according to the invention comprises the steps of sequentially locating beverage concentrate containers on a conveyor, placing measured matered quantities of at least two different beverage concentrate materials in each said container at spaced apart stations along said conveyor, positioning a closure lid on each said container, heat sealing the entire lid on said container, optionally date stamping or marking the lid of said container, removing said container from said conveyor and transferring it to a transfer point, placing beverage cups on a second conveyor said cups moving towards said transfer point, applying pressure to said container at said transfer point to drive same home into the base of said cup, and removing said cups from said second conveyor.

The foregoing is a description of a preferred embodiment of the invention which is given here by way of example only. The invention is not to be taken as limited to any of the specific features as described but comprehends all such variations thereof as come within the scope of the appended claims.

What is claimed is:

1. Apparatus for filling and assembling single serving beverage cups, said cups having a container of beverage concentrate secured therein, said apparatus comprising;

first conveyor means for carrying said containers;

means for placing said containers on said first conveyor means;

at least two beverage concentrate dispensing means located at spaced apart stations along said conveyor means, and being adapted to dispense beverage concentrate in predetermined measured quantities ino said containers;

container closure dispensing means for dispensing closures, and placing the same on said containers;

sealing means for sealing said closures on said containers;

second conveyor means for conveying said cups;

dispensing means for dispensing cups and placing the same on said second conveyor means;

transfer means for transferring said containers from said first conveyor means and placing same in registration with said cups on said second conveyor means; and pressure means for engaging said containers and pressing same into the bottom of said cups.

2. Apparatus as claimed in claim 1 wherein one of said concentrate dispensing means incorporates an auger feed system, and adjustment means for adjusting the amount of concentrate delivered thereby to each container.

3. Apparatus as claimed in claim 1 wherein said closures for said containers are adapted to be heat sealed to said containers, and wherein said closure dispensing means includes spot heat sealing means, whereby to heat seal a small area of said closure to a portion of said container when the same is deposited in position thereon to prevent the same from being displaced during movement of said container on said first conveyor means.

4. Apparatus as claimed in claim 1 including a third said beverage concentrate dispensing means, and wherein one of said beverage concentrate means at least is adapted for dispensing accurately measured quantities of coarse granular beverage concentrate material, said beverage concentrate containers being arranged along said first conveyor means whereby a container passing thereon passes in registrations sequentially one after the other with said beverage concentrate dispensing means.

5. Apparatus as claimed in claim 4 wherein said beverage concentrate dispensing means for said coarse granular material incorporates an auger feed mechanism, and adjustment means for adjusting the amount of said concentrate material fed by said auger feed mechanism, and further incorporates spout means movable into and out of each said cup, said spout means being in communication with said beverage concentrate dispensing means, for delivering said beverage concentrate therefrom into said container.

6. Apparatus as claimed in claim 1 wherein said container closures incorporate a tag portion extending from one side thereof, and including magazine means for storing said closures, and delivery means for holding one of said closures, and removing same from said magazine and depositing same on said container, with said tag means extending to one side of said container.

7. Apparatus as claimed in claim 1 wherein said transfer means for transfering said containers from said first to said second conveyor means includes lifting means for lifting a said container off said first conveyor and moving same to a predetermined register position in registration with a said cup, said cup being located beneath said container.

8. Apparatus as claimed in claim 7 wherein said pressure means comprises a plunger member moveable upwardly and downwardly, out of and into a said cup for pressing a said container therein.

9. Apparatus as claimed in claim 1 including removal means for removing said cups from said second conveyor after insertion and pressing of said container therein.

* * * * *